US006568472B1

(12) United States Patent
Gano et al.

(10) Patent No.: US 6,568,472 B1
(45) Date of Patent: May 27, 2003

(54) METHOD AND APPARATUS FOR WASHING A BOREHOLE AHEAD OF SCREEN EXPANSION

(75) Inventors: John C. Gano, Carrollton, TX (US); Henry L. Restarick, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/746,669

(22) Filed: Dec. 22, 2000

(51) Int. Cl.[7] ..... E21B 23/00; E21B 37/08

(52) U.S. Cl. ..... 166/207; 166/157; 166/312

(58) Field of Search ..... 166/380, 312, 166/207, 227, 157

(56) References Cited

U.S. PATENT DOCUMENTS

| | | | | |
|---|---|---|---|---|
| 1,259,721 A | * | 3/1918 | Carden | 166/186 |
| 1,514,062 A | | 11/1924 | McLain | |
| 3,179,168 A | | 4/1965 | Vincent | |
| 3,191,677 A | * | 6/1965 | Kinley | 166/207 |
| 3,203,483 A | | 8/1965 | Vincent | |
| 3,270,817 A | | 9/1966 | Papaila | |
| 3,353,599 A | | 11/1967 | Swift | |
| 3,477,506 A | | 11/1969 | Malone | |
| 3,498,376 A | | 3/1970 | Sizer et al. | |
| 3,669,190 A | | 6/1972 | Sizer et al. | |
| 3,746,091 A | | 7/1973 | Owen et al. | |
| 3,776,307 A | | 12/1973 | Young | |
| 3,861,465 A | * | 1/1975 | Mignotte | 166/127 |
| 4,095,825 A | | 6/1978 | Butler | |
| 4,279,306 A | * | 7/1981 | Weitz | 166/147 |
| 4,687,232 A | | 8/1987 | Zimmerman | |
| 4,899,821 A | * | 2/1990 | Casida | 166/222 |
| 5,014,779 A | | 5/1991 | Meling et al. | |
| 5,348,095 A | * | 9/1994 | Worrall et al. | 166/380 |
| 5,366,012 A | * | 11/1994 | Lohbeck | 166/207 |
| 5,667,011 A | | 9/1997 | Gill et al. | |
| 5,850,875 A | | 12/1998 | McCullock et al. | |
| 5,924,745 A | | 7/1999 | Campbell | |
| 5,931,232 A | | 8/1999 | Echols et al. | |
| 5,984,568 A | | 11/1999 | Lohbeck | |
| 6,012,522 A | * | 1/2000 | Donnelly et al. | 166/207 |
| 6,012,523 A | | 1/2000 | Campbell et al. | |
| 6,021,850 A | | 2/2000 | Wood et al. | |
| 6,029,748 A | | 2/2000 | Forsyth et al. | |
| 6,039,117 A | * | 3/2000 | Mueller | 166/312 |
| 6,070,671 A | | 6/2000 | Cumming et al. | |
| 6,263,966 B1 | * | 7/2001 | Haut et al. | 166/230 |
| 6,325,305 B1 | * | 12/2001 | Kuhlman et al. | 166/222 |
| 6,352,112 B1 | * | 3/2002 | Mills | 166/207 |

FOREIGN PATENT DOCUMENTS

| | | |
|---|---|---|
| GB | 2 344 606 A | 6/2000 |
| GB | 2344606 A | 6/2000 |
| WO | WO96/37680 | 11/1996 |
| WO | WO 96/37680 | 11/1996 |
| WO | WO 97/17527 | 5/1997 |
| WO | WO 98/49423 | 11/1998 |
| WO | WO 99/56000 | 11/1999 |
| WO | WO 9956000 | 11/1999 |
| WO | WO 00/26500 | 5/2000 |
| WO | WO 00/26501 | 5/2000 |
| WO | WO 00/26502 | 5/2000 |

* cited by examiner

*Primary Examiner*—David Bagnell
*Assistant Examiner*—Daniel P Stephenson
(74) *Attorney, Agent, or Firm*—Peter V. Schroeder

(57) ABSTRACT

The invention provides apparatus and methods for washing a wellbore ahead of an expansion swedge and radially expanding a sand-control screen jacket in a subterranean well. The methods and apparatus can be used in either the bottom-up or top-down direction and can accomplish borehole washing and screen expansion in a single trip.

26 Claims, 3 Drawing Sheets

METHOD AND APPARATUS FOR WASHING A BOREHOLE AHEAD OF SCREEN EXPANSION

TECHNICAL FIELD

The present inventions relate to an apparatus and methods for washing a borehole in a subterranean wells and for expansion of a radially expandable sand-control screen in the borehole.

BACKGROUND OF THE INVENTIONS

The control of the movement of sand and gravel into a wellbore has been the subject of much importance in the oil production industry. The introduction of sand materials into the well commonly causes problems including, plugged formations or well tubings, and erosion of tubing and equipment. There have therefore been numerous attempts to prevent the introduction of sand and gravel into the production stream. One sand control method includes the placement of a radially expandable screen assembly in the borehole.

Another problem in the art is the flow resistance often encountered at the wall of the hole, commonly referred to as the "skin factor". The skin factor at the wall of the wellbore must often be reduced before a sand-control screen assembly is installed in the formation. It is known in the art to reduce skin factor by washing the wellbore with a fluid chosen for well and formation conditions. Washing procedures also function to flush loose sand, cuttings and other debris from the borehole. The washing is performed in a trip downhole separate from the one or more trips needed for installing and expanding the screen jacket assembly. Each trip downhole requires additional time and expense.

Due to the aforementioned problems, a need exists for improved apparatus and methods for reducing skin factor in a wellbore and expanding a radially expandable sand-control screen jacket assembly in the well.

SUMMARY OF THE INVENTIONS

The present invention relates to an apparatus and method for washing a subterranean well borehole and radially expanding a screen assembly therein. The apparatus comprises a radially expandable screen assembly, a washing assembly adjacent the screen assembly for washing the borehole annular space, and an expansion assembly for radially expanding the screen assembly. The washing assembly can include a washing assembly housing having a wall defining an interior passage, a wash port through the housing wall for providing fluid communication between the interior passage of the washing assembly and the borehole annular space, and a flow control element affixed to the washing assembly housing for substantially preventing fluid flow along the screen annular space. The apparatus can include a force generator, preferably hydraulically powered by the washing fluid, for operating the expansion assembly. The expansion assembly can include a radially expandable swedge. The method of expanding the screen may be in the downhole or uphole direction.

The apparatus can further comprise a return flow passage providing fluid communication between an area of the borehole downhole from the expansion assembly to an area of the borehole uphole from the expansion assembly. The return flow passage can include closeable return ports, and a relief valve.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
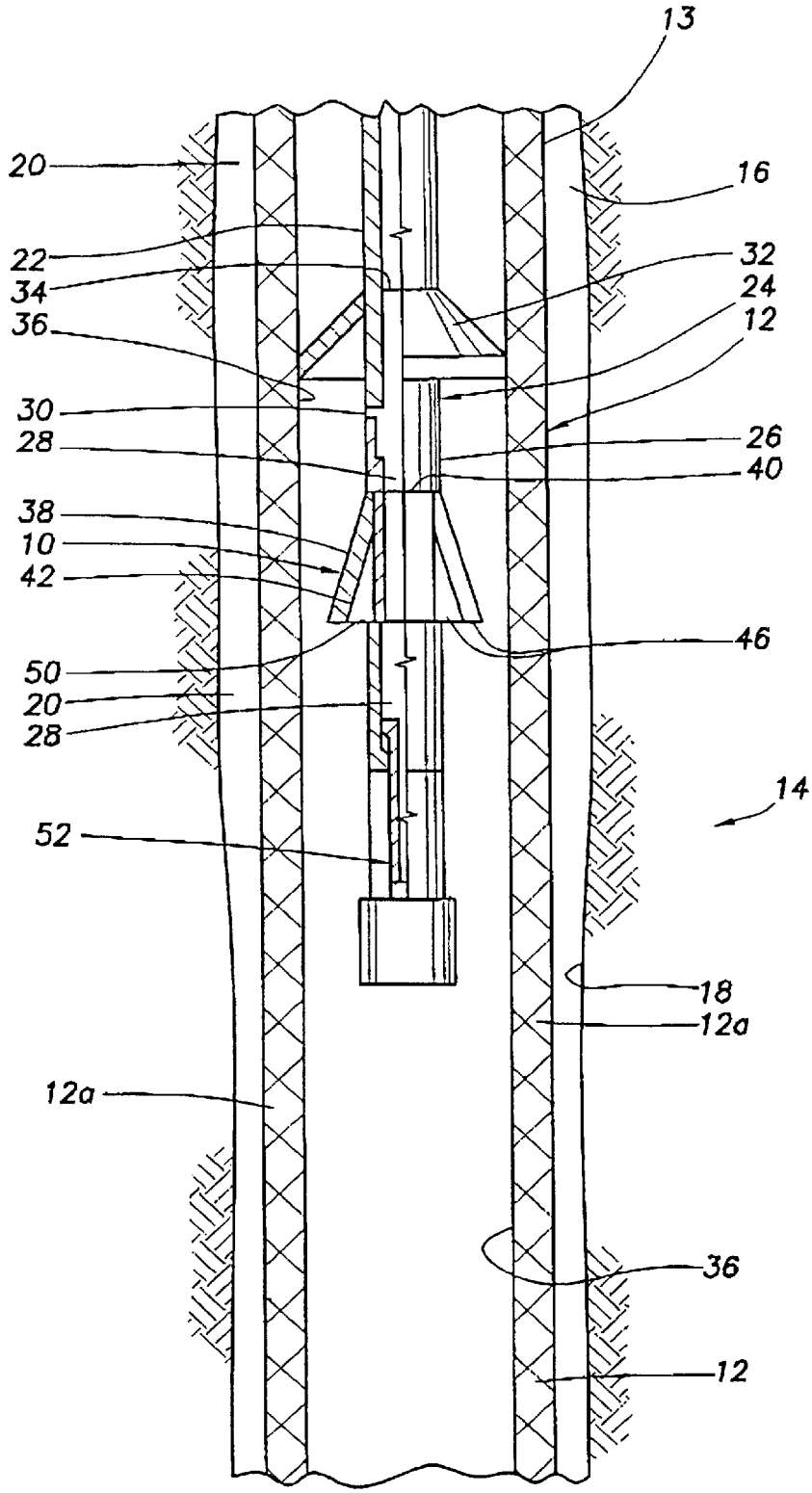
FIG. 1 is a longitudinal cross-sectional view of apparatus and steps in methods of washing the annular borehole ahead of expanding a radially expandable sand-control screen jacket in accordance with the present invention.

The present inventions are described by reference to drawings showing one or more examples of how the inventions can be made and used. In these drawings, reference characters are used throughout the several views to indicate like or corresponding parts.

In the description which follows, like or corresponding parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like, as used herein, shall mean in relation to the bottom, or furthest extent of, the surrounding wellbore even though the wellbore portions of it may be deviated or horizontal. The term "longitudinal" shall be used in reference to the orientation corresponding to the upward and downhole directions. Correspondingly, the "transverse" orientation shall mean the orientation perpendicular to the longitudinal orientation.

Figure 2:
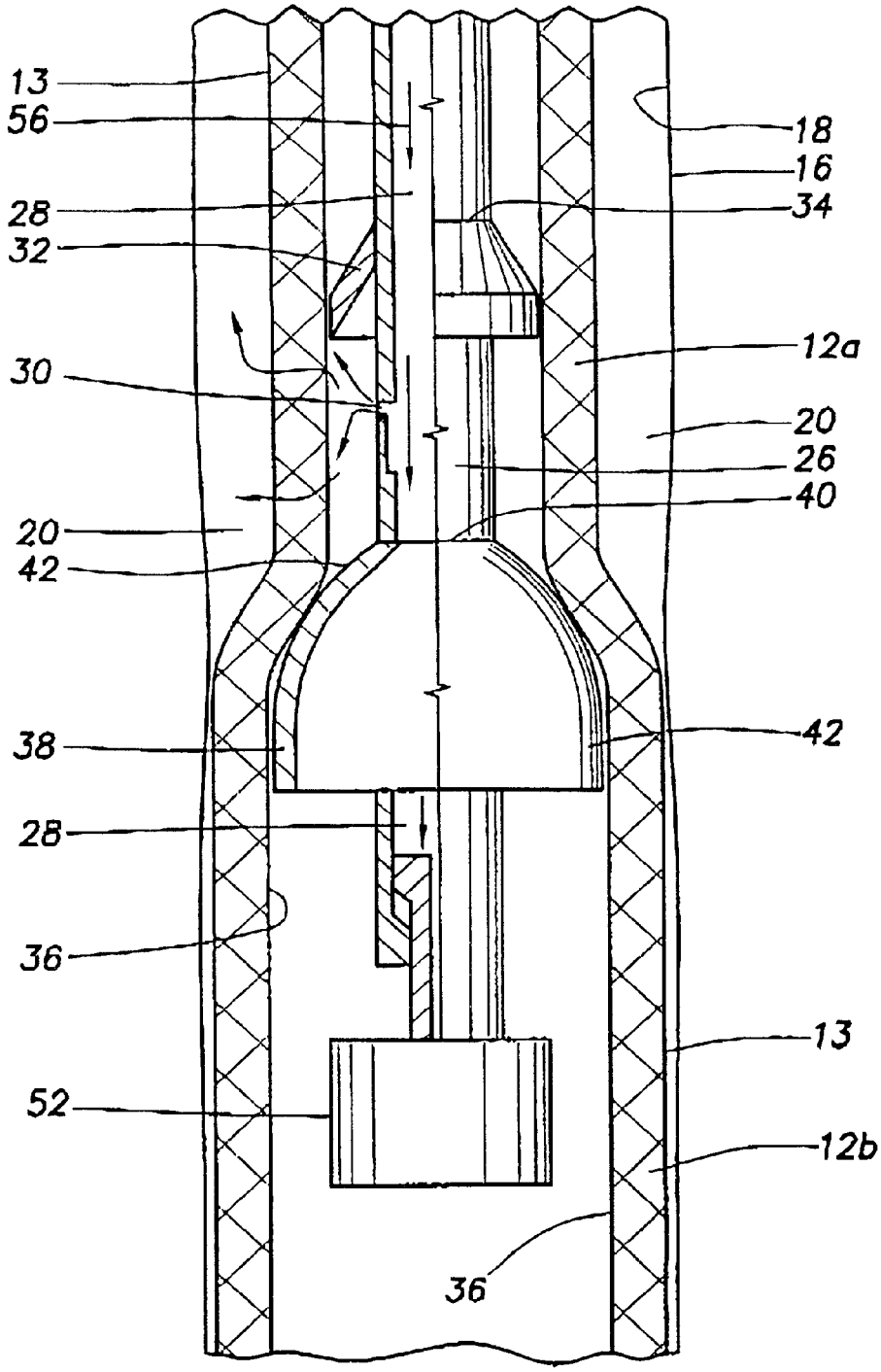
FIG. 2 is a longitudinal cross-sectional view of apparatus and steps in methods of using the invention.
Figure 3:
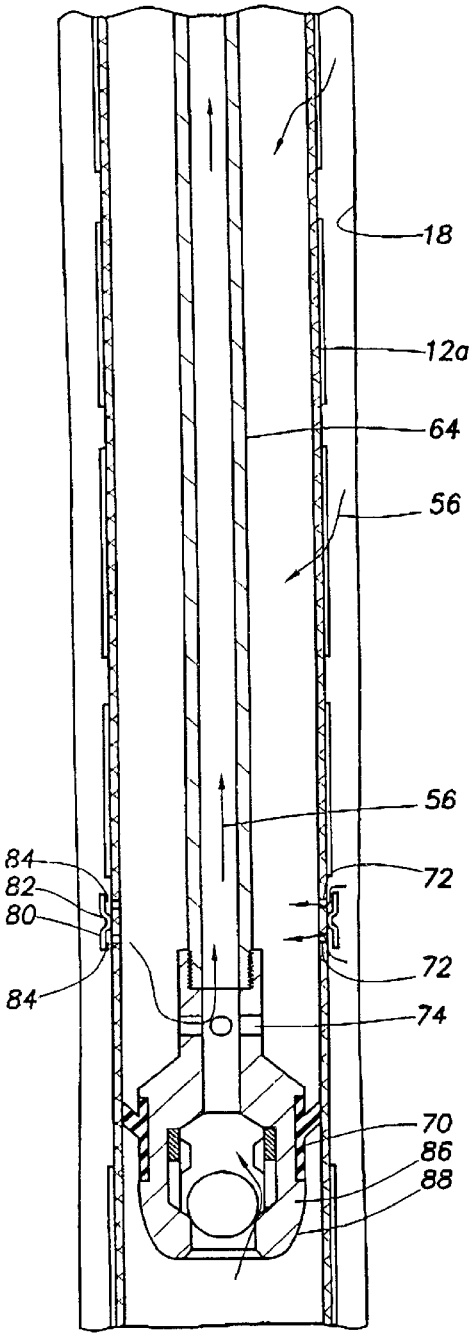
FIG. 3 is a longitudinal cross-sectional view of another embodiment of apparatus and methods of the invention.

Referring broadly to FIGS. 1–3, the general structure and methods of using the expansion assembly 10 utilizing the present inventive concepts is shown. A radially expandable screen jacket assembly 12 is deployed into the production zone 14 of a wellbore 16. It should be understood that the screen jacket assembly 12 may be connected to a casing at either end (not shown), in the conventional manner. When differentiating between the expanded and unexpanded states of the screen jacket assembly, the illustrations carry the designations 12*a*, referring specifically to the unexpanded screen jacket assembly, and 1 2*b*, referring specifically to the expanded screen jacket assembly. The sand-control screen jacket assembly 12 may be comprised of one or more concentric inner and outer screens (not shown) with or without a layer of pre-packed sand (not shown) between screens. The screen jacket assembly 12 may optionally have a screen shroud (not shown) concentrically surrounding the screens. The exact configuration of the screen jacket assembly 12 is not critical to the invention and may be varied by those skilled in the arts. The screen jacket assembly is generally constructed around a base pipe (not shown), which has a plurality of perforations through which fluids can communicate between the interior of the base pipe and the wellbore 16.

Now referring primarily to FIG. 1, with the radially expandable sand-control screen jacket assembly 12 positioned in the desired location 14 of the wellbore 16 in the conventional manner, an annular space 20 exists between the outermost surface 13 of the unexpanded screen jacket 12*a* and the wall 18 of the wellbore 16. The expansion assembly 10 is positioned concentrically within the radially expandable sand-control screen jacket assembly 12. The expansion assembly 10 is preferably connected to the terminal end of a conventional pipe string 22. The pipe string 22 is a fluid communication with a fluid pump as shown), used to supply fluid to the expansion assembly 10. The expansion assembly 10 has a washing assembly 24 preferably at its upper end. The washing assembly 24 has a housing 26 with a main passage 28 to allow fluid communication longitudinally throughout its length. Preferably, a washing port 30 is located in the side of the washing assembly housing 26 in fluid communication with the main passage 28. The washing port 30 is sized to divert a portion of the fluid flow from the main port 28 to the exterior of the washing assembly housing 26. Optionally, a plurality of washing ports may be used. A seal element 32 is affixed adjacent the forward end 34 of the washing assembly 10. The seal element 32 is preferably made from elastomeric material and is in substantially fluid-sealing contact with the inner surface 36 of the unexpanded screen jacket assembly 12*a*.

Still referring primarily to FIG. 1, a swedge portion 38 of the expansion assembly 10 is connected to the lower end 40 of the washing assembly housing 26. The main passage 28 continues through the center of the swedge portion 38 of expansion assembly 10. The swedge portion 38 is in the general shape of a truncated cone or circular wedge. The outer surface 42 of the swedge 38 is preferably defined by a plurity of segments 46. The segments 46 are moveable by means of fluid pressure communicated from the main passage 28 in a manner known in the arts, having a radially expanded position (not shown) and a radially retracted position as shown in FIG. 1. The swedge segments 46 preferably have grooves along at least a portion of their surfaces. Optionally, the swedge 38 may be non-expandable or smooth-surfaced. As shown in the art, if a non-expandable swedge is used (not shown), it must be placed adjacent to an end of the unexpanded screen jacket assembly for movement into the screen jacket assembly during the step of expanding the screen jacket assembly.

Further referring primarily to FIG. 1, the lower end 50 of the swedge 38 is preferably connected to a force generator 52. The main passage 28 continues through the force generator 52, which is preferably hydraulically operated The force generator 52 is capable of forceful longitudinal movement between an extended position (not shown) and a home position, depicted in FIG. 1. The preferred downhole force generator 52 has a nippleless lock for selectable radial locking in contact with the inner surface 36 of the screen jacket assembly 12. The nippleless lock has a radially locking position (not shown) and a radially contracted position, shown in FIG. 1. Optionally, other downhole force generators may be used to longitudinally drive the expansion swedge with sufficient force to expand the screen jacket assembly as are known in the art. For example, a system such as that disclosed in U.S. Pat. No. 5,492,173, which is assigned to this assignee and is incorporated herein for all purposes by this reference, can be used. The downhole force generator is preferably self-contained, or may be in communication to the surface via slickline, power connections, or control connections. The exact configuration of the force generator and lock are not crucial to the invention so long as selectable directed force is provided to the swedge 38.

Referring now primarily to FIG. 2, the expansion assembly 10 is shown in the expanded position with the radially expandable sand-control screen jacket 12 partially enlarged by the swedge 38. The swedge 38 is forced, upward as shown here, by force generator 52, thereby expanding the screen assembly 12 from its run-in position 12*a* to its expanded position 12*b*. Washing fluid 56 is pumped through the pipe string 22 into the main passage 28. The flow path of the washing fluid 56 is shown by the arrows in FIG. 2. In particular, the washing fluid 56 flows into the main passage 28 at the forward end 34 of the washing assembly housing 26. A portion of the washing fluid 56 flows through wash port 30. The washing fluid 56 flowing through wash port 30 flows through the unexpanded portion of the screen jacket assembly 12*a* and into the annular space 20 between the outer surface 13 of the unexpanded screen jacket assembly 12*a* and the wellbore wall 18. The flow of washing fluid 56 from the wash port 30 into the annular space 20 surrounded by the seal element 32 and by the swedge outer surface 42 proximal to the lower end 40 of the washing assembly housing 26. The fluid flow in the annular space 20 is preferably turbulent but may optionally be laminar. The fluid flow in the annular space 20 washes debris from the screen surface and from the annular space 20 and scours the wall 18 of the wellbore 16 reducing skin factor. Preferably, the washing fluid 56 also flows through grooves in the swedge 38, washing the screen 12 and annular space 20 where the swedge outer surface 42 contacts the inner surface 36 of the screen jacket assembly 12.

The composition of the washing fluid 56 may be varied according to well and formation conditions. For example, fluid 56 may be water or an acid solution. Further referring primarily to FIG. 2, the washing fluid 56 may be used to hydraulically operate the swedge 38. As the washing fluid 56 flows through passage 28, the swedge expands radially. The radial expansion of the swedge surface 42 in turn causes the screen jacket assembly 12*b* to radially expand into the annular space 20 between the outer surface 13 of the screen jacket assembly 12 and the wall 18 of the wellbore 16. Optionally, the swedge 38 may be operated via a separate hydraulic, mechanical or electrical actuator.

The washing fluid 56 may further be employed to actuate the force generator 52. The flow of the washing fluid 56 also causes the preferred force generator 52 to move from a home position (not shown) to an extended position as shown in FIG. 2, driving the swedge 38 and washing assembly 24 upward through the screen jacket assembly 12. The force generator 52 may include other elements such as a radially expanding lock, not shown, as is know in the art. As the washing assembly 24 and swedge 38 are advanced through the screen jacket assembly 12, the screen jacket assembly 12*a* is radially expanded, 12*b*. When the force generator 52 becomes fully extended, it is moved up hole into a home position, thereby "inch worming" the assembly along the well bore, as is known in the art. The swedge 38 may act as an anchor when advancing the force generator. The washing and expanding process described above may be repeated. The operation rate repeated until the desired length of screen jacket assembly has been expanded.

In an alternative embodiment of the invention depicted in FIG. 3, the expansion assembly 10 and methods may be used for radially expanding a sand-control screen jacket assembly 12 in a subterranean well from top-to-bottom, that is, in the downhole direction.

Washing fluid 56 is pumped downhole into main passage 28. As with the bottom-up method previously discussed, fluid 56 may be used to drive the swedge 38 along the length of the screen assembly 12, thereby expanding it from its run-in position 12*a* to its expanded position 12*b*. At least a portion of washing fluid 56 flows out of the passage 28 through wash port 30.

Optionally, the washing assembly is provided with a trash tube 58 having a passage 28*a* through which fluid 56 flows. The washing assembly may also have a flow control orifice 60 sized to regulate the flow rate once the fluid 56 is at expansion pressure.

Upon exiting the housing 26 via port 30, the fluid 56 flows downhole along the annular space 62 between the return pipe 64 and the inner surface 36 of the screen 12. Fluid 56 is prevented from flowing uphole by flow control seal 66. Port 30 is located downhole from flow control seal 66. Fluid 56 may flow into annular space 62 along grooves provided on the exterior of swedge 36 for that purpose.

Flow control seal 68, which blocks the annular space 62 downhole of swedge 38, forces the fluid 56 to flow outward from annular space 62 through the screen assembly 12 and into the annular space 20 formed between the unexpanded screen 12*a* and the wall 18 of the borehole 16.

The washing fluid 56, pushed outward through the screen assembly 12 by the advancing expansion swedge 38 washes any build-up from the outer surface 13 of the screen assembly 12. Fluid 56 flows downhole through annular space 20 and washes the borehole 16, thereby reducing the skin factor of the borehole and washing cuttings, loose filter and other debris from the borehole.

Downhole from flow control seal 68, is located a similar flow control seal 70. A portion of fluid 56 may flow back through the screen assembly 12, below seal 68, from annular space 20 to annular space 62. Washing fluid 56, or a portion thereof, may also continue to flow downhole along annular space 62, carrying mud, suspended materials, cuttings and loose filter cake with it.

Optional return ports 72 are provided in the preferred embodiment. Portions of fluid 56, carrying debris, may return to annular space 62 through return ports 72.

Washing fluid 56 flows through wash port 74 into passage 28*b* in return pipe 64. Washing fluid 56 returning to the surface, uphole, passes along passage 28*b*, through wash port 76, which may optionally be capable of opening and closing, and upward along annular space 62 above flow control seal 66.

Figure 4:
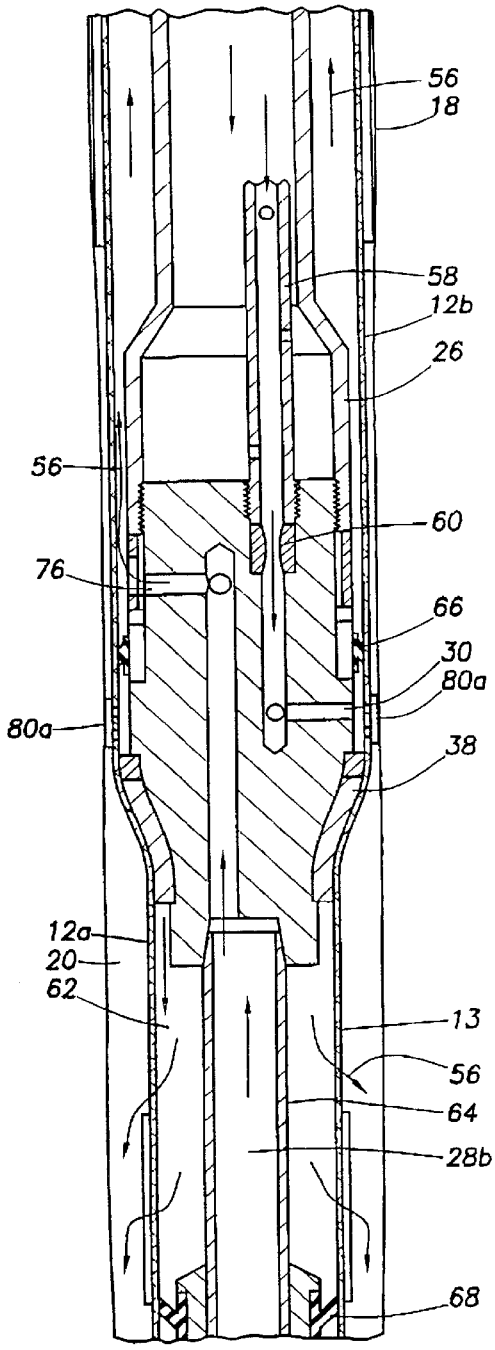
FIG. 4 is a longitudinal cross-sectional view of an embodiment of apparatus and methods of the invention.

Circulation ports 72 may optionally be closeable, allowing the ports to be sealed after expansion of the screen assembly 12 such that production fluids must flow through the screen assembly 12 rather than through the ports 72. One preferred method of closing ports 72 is shown in FIG. 4 although other methods are known in the arts. Port closure plate 80 is located adjacent the ports 72 on the outer surface 13 of the screen assembly at attachment 82 as shown. When the screen assembly 12 is in its run-in, or un-expanded state 12*a*, the closure plate does not prevent flow of fluid 56 through ports 72. As swedge 38 expands screen assembly 12, he closure plate 80 is bent and flattened against the outer surface 13 of the screen assembly 12 thereby covering ports 72 and preventing further fluid flow through the ports 72, as seen at 80*a* in FIG. 3. Optionally, rubber seals 84 are provided.

Optionally, return pipe 64, at its downhole end, may be provided with a float shoe assembly 86. Fluid 56, flowing into annular space 62 downhole from flow control seal 70, may flow through check valve 88. Check valve 88 acts as a relief valve, allowing fluid from downhole to flow into the return pipe 64 when a selected downhole pressure is achieved.

It will be clear to those skilled in the arts that the apparatus and methods disclosed may be used for top-down or bottom-up screen expansion and borehole washing. The inventions have several advantages over the apparatus and methods previously known in the art, including the advantages of pressure washing the annular space between the outer surface of the screen jacket assembly and the wall of the wellbore. The self-contained expansion tool also provides advantages including the elimination of surface connections. The radially expandable swedge of the preferred embodiment also has the advantage of being deployable in its unexpanded position through an unexpanded screen jacket assembly.

The embodiments shown and described above are only exemplary. Many details are often found in the art such as: force generator, screen jacket, or expansion swedge configurations and materials. Therefore, many such details are neither shown nor described. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed is:

1. An apparatus for washing a subterranean borehole and radially expanding a screen assembly comprising:

a washing assembly for washing the borehole; and an expansion assembly for radially expanding the screen assembly.

2. An apparatus as in claim 1 wherein the washing assembly further comprises:

a washing assembly housing having a housing wall, the housing wall defining an interior passage therein;

a wash port through the housing wall for providing fluid communication between the interior passage of the washing assembly and the borehole annular space; and a flow control element affixed to the washing assembly housing for substantially preventing fluid flow along a screen annular space, the screen annular space defined by the inner surface of the screen assembly and the wall of the housing assembly.

3. An apparatus as in claim 1 further comprising a force generator for operating the expansion assembly.

4. An apparatus as in claim 1 wherein the force generator is hydraulically operable by washing fluid pumped into the subterranean well.

5. An apparatus as in claim 1 wherein the expansion assembly includes a radially expandable swedge.

6. An apparatus as in claim 1 wherein the expansion assembly operates in the downhole direction.

7. An apparatus as in claim 6 further comprising a return flow passage providing fluid communication between an area of the borehole downhole from the expansion assembly to an area of the borehole uphole from the expansion assembly.

8. An apparatus as in claim 7 wherein the return flow passage includes at least one closeable return port.

9. An apparatus as in claim 7 wherein the return flow passage further includes a relief valve.

10. An apparatus as in claim 1 further comprising a radially expandable screen assembly.

11. A method of working a subterranean well having a borehole, the method comprising the steps of:

running in a downhole tool assembly having a washing assembly and an expansion assembly for radially expanding a sand screen assembly;

expanding the sand screen assembly in the borehole; and flowing washing fluid through at least a portion of the borehole.

12. A method as in claim 11 wherein the steps of expanding the sand screen and flowing washing fluid are done simultaneously.

13. A method as in claim 11 further comprising the step of running in a downhole tool assembly having a radially expandable screen assembly, a washing assembly adjacent the screen assembly, and an expansion assembly for radially expanding the screen assembly.

14. A method as in claim 13 wherein the washing assembly includes a housing having a housing wall, the housing wall defining an interior passage therein;

a wash port through the housing wall for providing fluid communication between the interior passage of the washing assembly and the borehole annular space; and a flow control element affixed to the washing assembly housing for substantially preventing fluid flow along a screen annular space, the screen annular space defined by the inner surface of the screen assembly and the wall of the housing assembly.

15. A method as in claim 14 wherein the step of flowing washing fluid through a portion of the borehole annular space further includes the steps of flowing washing fluid through the interior passage of the washing assembly housing, flowing washing fluid through the wash port of the washing assembly into the borehole annular space.

16. A method as in claim 15 wherein the step of flowing washing fluid through a portion of the borehole annular space further includes the step of flowing washing fluid from an interior passage of the screen assembly outward to the borehole annular space.

17. A method as claim 14, the washing assembly having a return passage for returning the washing fluid to the well surface, the method further comprising the step of flowing the washing fluid uphole to the surface of the well through the return passage, after the step of flowing washing fluid through a portion of the borehole annular space.

18. A method as in claim 17 wherein the step of flowing the washing fluid uphole further includes flowing the washing fluid uphole through the return passage in the washing assembly.

19. A method as in claim 11 further comprising the steps of:

running into the borehole an expandable screen assembly; and running into the borehole a washing assembly.

20. A method as in claim 11 wherein the step of expanding a screen assembly further comprises expanding a radially expandable swedge and running the expanded swedge through at least a portion of the screen assembly, thereby expanding the screen assembly.

21. A method as in claim 20 wherein the expanded swedge is run by the force of the washing fluid.

22. A method as in claim 11 wherein the step of flowing washing fluid through the borehole annular space further comprises flowing washing fluid from uphole of the portion of the borehole to be washed.

23. A method as in claim 11 wherein the screen assembly is expanded from the top downward.

24. A method as in claim 11 further comprising the step of flowing the washing fluid uphole to the surface of the well, after the step of flowing washing fluid through a portion of the borehole annular space.

25. A method as in claim 11 further comprising the step of running in a radially expandable screen assembly.

26. A method as in claim 11 wherein the sand screen assembly is expanded weight down.

* * * * *